US006523825B2

(12) United States Patent
Francis

(10) Patent No.: US 6,523,825 B2
(45) Date of Patent: Feb. 25, 2003

(54) SPATIAL GAME TOY

(75) Inventor: Geoffrey V. Francis, 521 Pipers Green, Oakville, Ontario (CA), L6M-1H2

(73) Assignee: Geoffrey V. Francis, Oakville (CA)

( * ) Notice: Subject to any disclaimer, the term of this patent is extended or adjusted under 35 U.S.C. 154(b) by 0 days.

(21) Appl. No.: 09/784,605

(22) Filed: Feb. 15, 2001

(65) Prior Publication Data

US 2001/0033056 A1 Oct. 25, 2001

Related U.S. Application Data

(60) Provisional application No. 60/182,632, filed on Feb. 15, 2001.

(51) Int. Cl.[7] ..... A63F 7/04
(52) U.S. Cl. ..... 273/153 R; 273/123 R
(58) Field of Search ..... 273/153 R, 153 S, 273/155, 156, 123 R, 109, 113, 115

(56) References Cited

U.S. PATENT DOCUMENTS 4,545,577 A * 10/1985 Randleman ..... 273/155
4,824,098 A * 4/1989 Huang ..... 273/153 R
4,861,036 A * 8/1989 Watanabe ..... 273/153 R
4,953,863 A * 9/1990 Zeidler et al. ..... 273/123 R
5,613,681 A * 3/1997 Allen ..... 273/153 R
6,241,249 B1 * 6/2001 Wang ..... 273/156

FOREIGN PATENT DOCUMENTS

GB 2320689 * 7/1998

* cited by examiner

*Primary Examiner*—Steven Wong
(74) *Attorney, Agent, or Firm*—Thoburn T. Dunlap

(57) ABSTRACT

A spatial puzzle game comprising a three dimensional array of transparent containers is disclosed. The containers are either fixed or movable relative to one another and each container has at least one hole it its surface. The movable containers are adapted for rotation about orthogonal axes. The holes of adjacent containers can be aligned by rotating the movable containers about their axes. Objects placed inside of the containers can be passed between containers when the holes of adjacent containers are aligned.

28 Claims, 9 Drawing Sheets

SPATIAL GAME TOY

This application claims the benefit of priority under 35 U.S.C. 119(*e*) from Provisional application Ser. No. 60/182,632, filed on Feb. 15, 2001.

BACKGROUND OF THE INVENTION

1. Technical Field

The present invention relates to a spatial logical game toy. More specifically, the invention relates to the field of three dimensional puzzles. The puzzle comprises an array of stationary and/or movable containers that are assembled in a three dimensional configuration. The container bodies are transparent and have at least one aperture on the surface thereof. The apertures of adjacent containers can be aligned by rotating the movable containers about multiple axes into aligning position. Objects placed within the containers can be passed from container to container by aligning the respective apertures of adjacent containers within the three dimensional array.

2. Background

Spatial toy puzzles are well known in the art. A puzzle marketed as "Rubik's Cube" still enjoys widespread popularity amongst logical game enthusiasts. Rubik's cube is a spatial logical toy consisting of twenty-six small cube-like elements which are arrayed in the configuration of a larger cube body. The array of smaller cubes can be turned along the spatial axes of the large cube body by means of connecting elements arranged in the interior of the larger cube body configuration. The outer surfaces of the smaller cube elements are colored and in combination define the outer faces of the larger cube body. The smaller cube elements can be assembled into a predetermined logical sequence or order by simultaneously rotating a group of the cubes elements.

When playing with such logical toys or puzzles, an initial predetermined pattern of cube elements is first randomized by moving the cube elements about the spatial axes of the cube body. Following the randomization of the cube elements, a player attempts to arrange the cube elements back into the original sequence. The efforts of the player are considered successful if the predetermined sequence or pattern is restored. The element of competition is only introduced by achieving the solution in the fewest amount of steps, or within the shortest amount of time. Like most logical puzzle games, this puzzle is best played by one player functioning alone. No provision is provided for opposing players to thwart an opponent's strategy or to arrive at a separate solution to solve the puzzle on the same game apparatus. U.S. Pat. No. 4,008,895 teaches a three-dimensional maze puzzle wherein a marble is manipulated through a series of interconnected passageways that are positioned on the faces of a polyhedron shaped body. As the interconnected passageways are fixed in relation to each other then it can be seen that a player would simply memorize the correct way to rotate the puzzle and then quickly lose interest. Again, this puzzle is best played by one player functioning alone.

Accordingly, there remains a need for a logical puzzle toy or game that can be played by one or a multiplicity of players, each having an opportunity to oppose the other's moves and to implement independent solution strategies for solving the puzzle.

SUMMARY OF THE INVENTION

It is an object of the invention to provide a three dimensional spatial puzzle game that can be played by one or more players.

It is another object of the invention to provide a puzzle game configuration which offers a wide range of step variations allowing for the playing of a variety of games having differing rules of play.

It still a further object of the invention to provide a puzzle game that maintains a player's attention, improves mechanical aptitude, and develops logical thought skills.

It is a further object of the invention to provide a puzzle game piece that is easily manufactured and easy to assemble.

These and other objects of the invention are achieved by a spatial logical puzzle toy comprising a three dimensional array of adjacent fixed and rotatable containers having at least one aperture in the surface thereof, an object within at least one of said containers capable of being transferred between adjacent containers, and means for aligning the apertures in adjacent containers allowing the objects to pass from one adjacent container to another.

Other objects, features, and advantages of the invention will become apparent from the specification and drawings in which like numerals refer to like elements in the several views of the invention set forth in the accompanying figures.

DETAILED DESCRIPTION

Figure 1:
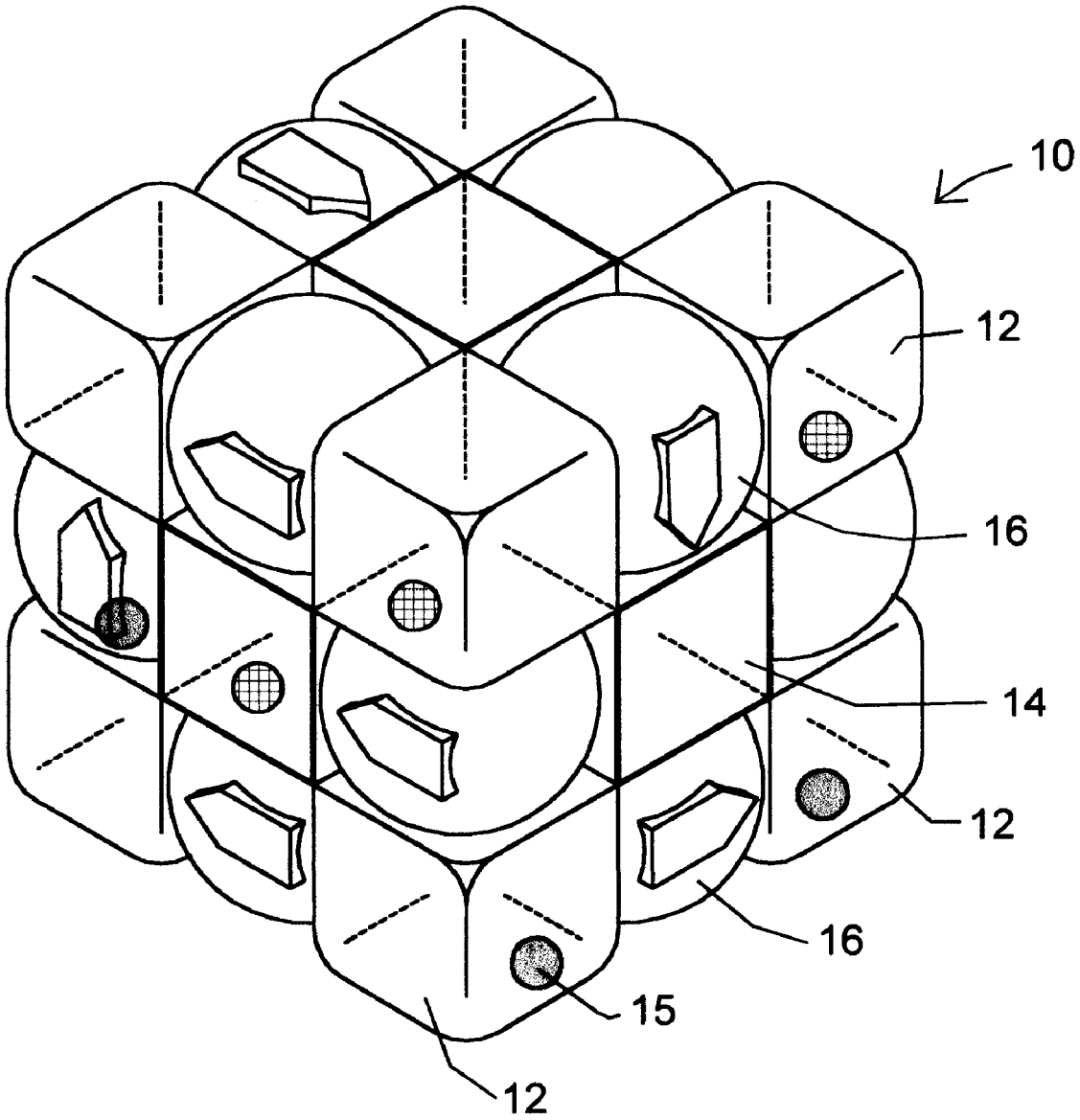
FIG. 1 is an isometric view of the spatial puzzle game of the invention.

An embodiment of the spatial puzzle game of the invention comprising a three dimensional array of adjacent transparent containers is described. Referring to FIG. 1, a puzzle game 10 comprises twenty-six transparent containers arranged within a matrix body (shown in FIG. 2) in a cube-like configuration or array. In one aspect of the invention, the puzzle contains eight corner containers 12, six face containers 14, and twelve edge containers 16. The corner containers 12 and face containers 14 are integral with and fixed within the matrix body, while the edge containers 16 are recessed in and rotatable within the matrix about their orthogonal axes. In another aspect of the invention the corner containers and face containers can be of a cube-like configuration and the edge containers can be spherical in configuration. As used here and throughout the specification by cube-like is meant that the container or configuration is preferably formed in the shape of a cube but it may be essentially any shape providing it is not deleterious to the operation of the invention. As used here and throughout the specification by spherical is meant that the container or configuration is formed in the shape of a sphere at those parts of its surface that are required to abut the bearing elements but otherwise it may be essentially any shape providing it is not deleterious to the operation of the invention. The container bodies 12, 14, and 16 have at least one aperture (not shown) through a wall, shell, envelop or surface thereof. In one aspect of the invention, apart from the aperture(s) that penetrates through the wall, shell, envelop or surface of the container bodies, the container body is generally of a closed configuration defined by the cube-like or spherical shape. It should be noted that the container walls, shell, envelop or surface can be solid, mesh-like or grill-like so long as the container wall, shell, envelop or surface is rigid and the interstices between wall, shell, envelop or surface portions are small enough not to permit game objects to fall out of the interior of the container. The wall, shell, envelop or surface apertures of adjacent containers can be aligned by rotating an edge container 16 about its orthogonal axes into an aperture aligning position. When the apertures of adjacent containers are aligned, the interiors of the adjacent containers are in contact, communication or connection with each other. A game object 15 such a ball(s), marble(s), bead(s), sand, gel(s), etc., placed within a container(s) can be transferred or moved from container to container by aligning the respective apertures of adjacent containers within the three dimensional array. Conversely, aligned apertures of adjacent containers can be blocked by rotating an edge container out of aperture aligning position thus blocking the transfer of the object between containers.

Figure 2:
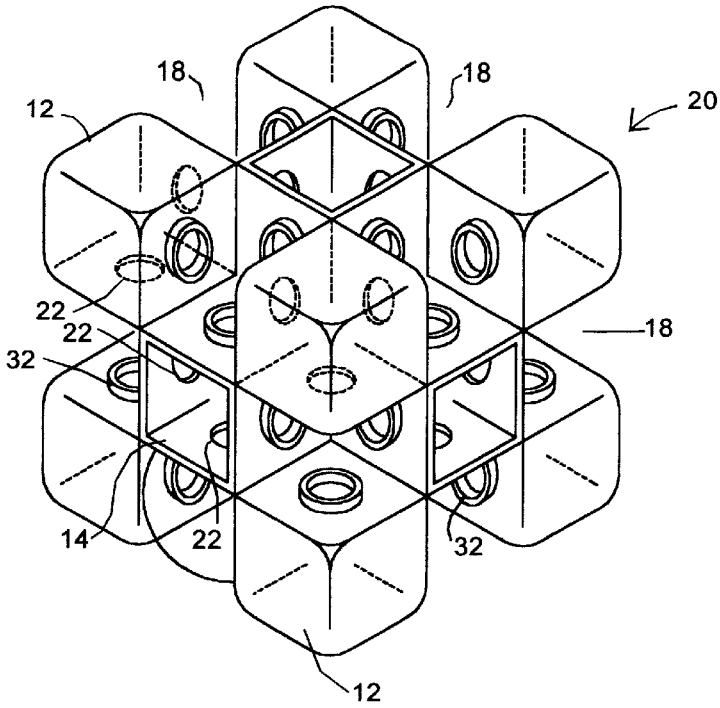
FIG. 2 is a perspective schematic view of the matrix body of the invention.
Figure 3:
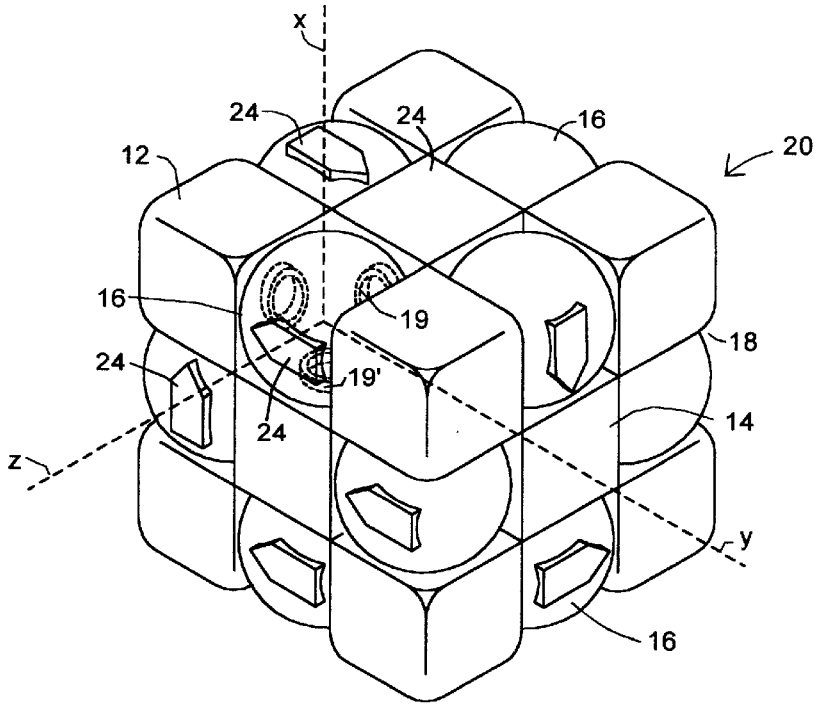
FIG. 3 is a perspective schematic view of the spatial puzzle game of the invention.

As shown in FIG. 2, matrix body 20 of puzzle game 10 is cube-like in configuration. In this embodiment, the matrix body comprises twenty-seven smaller cube elements, twenty-six of which are utilized as the container components 12, and 14, or to house container component 16 of the puzzle. As shown in FIG. 3 each face of the matrix body comprises a 3 by 3 array of containers. A twenty-seventh container element (not shown) is located at the geometrical center of the cube-like matrix and serves merely as a structural element in the construction of the puzzle game or a space for storing unused game objects (e.g., marbles). The eight comer containers 12 are located at each comer of matrix body. The six face containers 14 are located at the center of each face of the cube-like matrix body. The matrix body contains twelve cube-like edge container recesses 18 that are positioned between each of the comer containers in the matrix. Recesses 18 are adapted to receive and facilitate the mounting and rotational movement of the spherical edge containers 16 therein. The corner and face containers 12 and 14, respectively, are completely enclosed having six sidewalls (FIG. 2 shows the face. containers with only 5 walls as the face cap (described later) is not shown. The twelve edge container recesses 18 that receive the edge containers have four walls. Each of the four walls of the edge container recesses are common with an adjacent corner container and a face container. The edge container recess is open on two sides to accommodate the movement of the edge container.

As is illustrated in FIG. 2 each of the eight corner containers 12 share a common wall with three adjacent edge container recess elements 18. In each of the common walls between the comer containers 12 and the three adjacent recess elements 18 there is an annular aperture 22. The aperture or bearing aperture 22 is positioned to provide a common portal between the corner containers and adjacent or contiguous edge containers. Each of the six face containers 14 share a common wall with four adjacent edge container recess elements 18. In each of the four common walls between the face containers 14 and edge container recesses 18 there is an annular aperture 22 that is positioned to provide a portal between the face container and adjacent edge container. Accordingly, each wall of edge container recess element 18 includes and aperture 22. Situated around the periphery of each aperture of the recess element is an annular bearing 32 having an inner circumferential wall that is coextensive with the periphery of the aperture 22. In one aspect of the invention apertures 22 in the corner and face container walls are positioned in the geometric center of the wall.

Referring now to FIG. 3 there is shown a schematic view of a puzzle game embodiment of the invention with matrix body 20 having fixed corner and face containers 12, 14, respectively, and movable edge containers 16. In this aspect, the edge containers 16 are spherical in configuration and are received for rotational mounting in recess(es) 18. By rotational mounting is meant that the edge container(s) 16 is mounted within recess element(s) 18 of matrix body 20 such that the spherical edge container is able to rotate about its orthogonal axes (x-, y-, and z-axes) relative to the geometric center of the sphere. As illustrated in the figure, an edge container 16 is shown with its orthogonal axes drawn through its geometric center. Edge container 16 is mounted by suitable mounting means (described below) enabling it to rotate 360° about the x-axis, pivot at least about 90° around the y-axis, and then rotate 360° about the z-axis. The edge containers include two apertures 19 and 19' set at right angles to each other. A handle 24 can be provided on the outer surface of the edge container to facilitate the rotation of the container when playing the game. In one aspect, the aperture 19' is situated 180° opposite the handle 24. When edge container 16 is rotated about its orthogonal axes, apertures 19, 19' can be aligned with apertures 22 of any adjacent corner or face container 12 and 14, respectively, forming a portal from one container to another. In this way objects placed in the containers can be made to move to adjacent containers throughout the matrix array.

Figure 4:
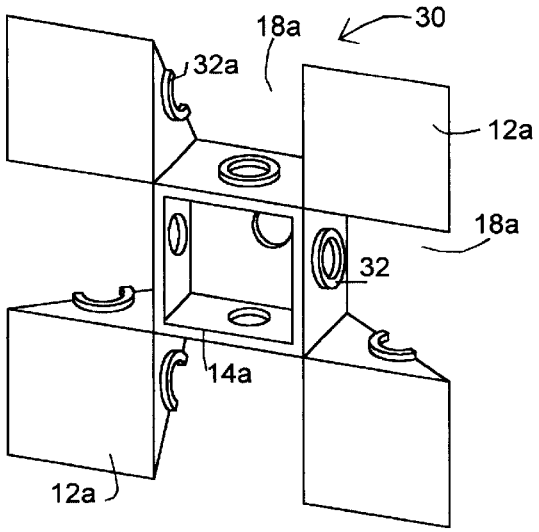
FIGS. 4 through 4*c* are front and rear perspective views showing various features of the matrix element utilized in the construction of the matrix body of the invention.

In one embodiment of the invention, matrix body 20 of the puzzle game is constructed from six identical matrix assembly elements that are assembled to form the matrix body configuration. Referring to FIGS. 4 and **4*a* there is shown the front and rear view, respectively, of a matrix assembly element 30. The matrix assembly elements can be molded from a plastic resin, such as ABS or polystyrene, that is transparent in the molded or finished state. Each of the six matrix assembly elements 30 includes a box-like face compartment 14*a* and four partial corner compartments 12*a* situated on the four corners of the face compartment. As shown is FIG. 4*a* the rear wall edges of box-like face compartment 14*a* include alignment tabs 38 that facilitate the assembly of the matrix body. Four partial edge container recess compartments 18*a* are situated between each of the partial corner compartments 12*a*. The matrix assembly elements are constructed with apertures 22 and partial apertures 22*a*. Each of the partial edge container recess elements 18*a* include one aperture 22 and two partial aperture precursor elements 22***a*. Partial recess element 18*a* includes an annular bearing 32 which outwardly depends from the circumferential edge of aperture 22. The inner diameters of aperture 22 and bearing 32 are of the same dimension. The partial aperture(s) 22*a* includes a partial bearing lip 32*a* that depends outwardly from the partial circumferential edge of aperture precursor 22*a*. The bearing elements, partial bearing elements, and alignment tabs can be integrally formed with the matrix element as the matrix element is manufactured.

Figure 4A:
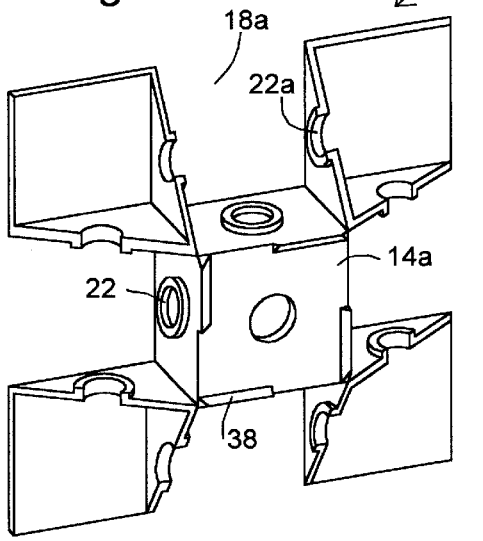
FIGS. 4*d* through 4*e* are front and rear perspective views of an alternative matrix element utilized in the construction of the matrix body of the invention.
Figure 4B:
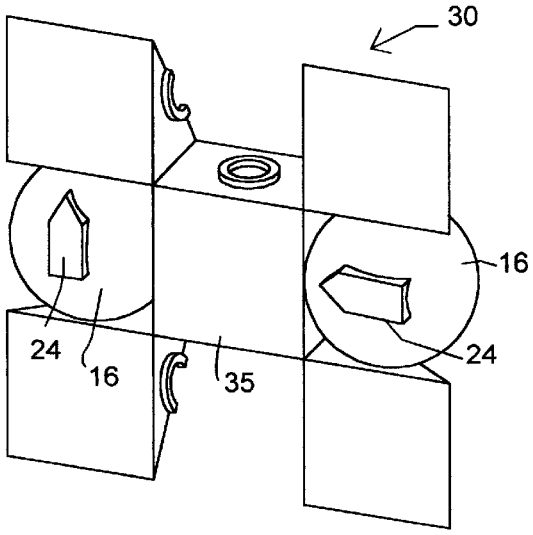
Figure 4C:
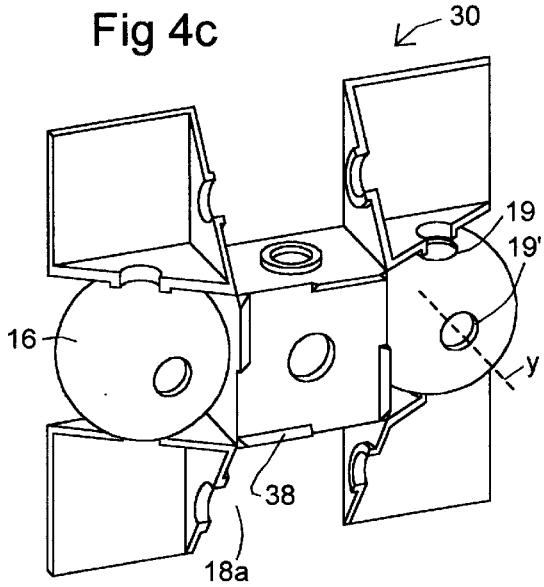

Referring to FIGS. 4*b* and 4*c* there is shown a front and rear view, respectively, of the matrix assembly element 30 described in FIGS. 4 and 4*a*. The figures are substantially identical except that the matrix assembly element 30 is shown with edge container(s) 16 mounted within the partial recess(es) 18*a*. Also, as illustrated in FIG. 4*b*, a center cap 35 is shown covering the face of face compartment 14*a*. The center cap is transparent and can be molded from a plastic resin. Cap 35 can either be fixed in position by welding or adhesive means or alternatively removably fixed by a snap fit mechanism to allow access to the container for loading objects such as marbles. As is illustrated in the figures, the spherical edge container 16 is mounted within partial recess 18*a*. In the fully assembled state the spherical edge container is secured for rotational movement about its orthogonal axes within the edge container recess 18 by bearings 32. As illustrated in FIG. 2 an edge container recess 18 is shown with four bearings 32 that depend outward from the circumferential periphery of apertures 22 into the edge container recess 18. The bearings are annular or ring-shaped having an inner and outer circumferential wall and a top circumferential edge that functions as the bearing contact surface. The inner wall of bearing(s) 32 is of the same diameter and contiguous with the walls of aperture(s) 22. Edge container 16 is mounted for rotational movement about its orthogonal axes between the bearings 32. The edge container 16 is of sufficient dimension to fit snugly between the bearing surfaces but able to rotate and pivot about its orthogonal axes. To facilitate the rotation of the edge container the top circumferential edge of each bearing can be beveled inward from the outer wall to the inner wall to conform to the curvature of the spherical edge container.

Figure 5:
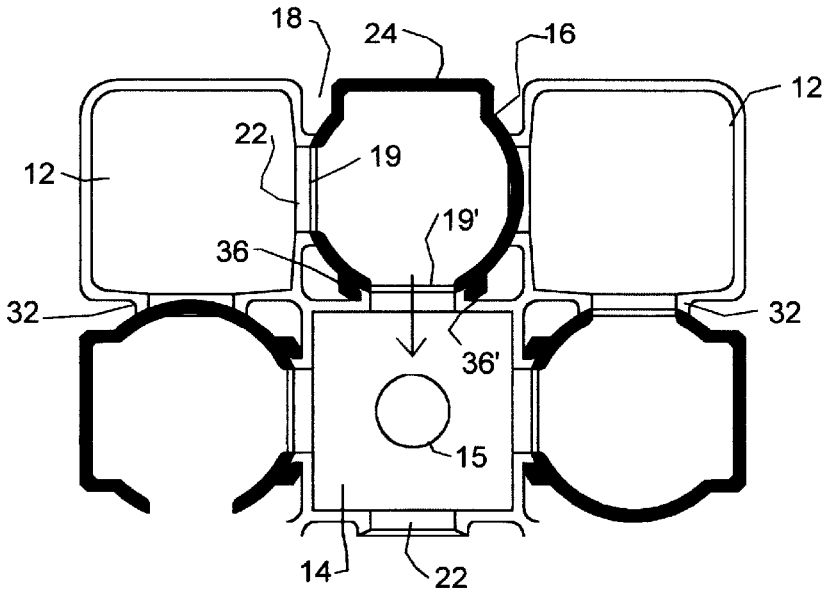
FIG. 5 is a partial sectional view of the game body of the invention illustrating various aspects of the container element construction.

Referring to FIG. 4*c*, edge container(s) 16 is shown mounted within partial recess element(s) 18*a*. In one aspect of the invention each of the interior aperture containing walls of corner containers 12 and face containers 14 of the invention are sloped toward the apertures to assist with the movement of objects as they pass from a fixed container 12, 14 through aperture 22 into spherical edge container 16. In another aspect, the pitch of the slope is approximately 1/10. As is evident in FIG. 5 when aperture 19, 19' of edge container 16 is aligned with an aperture 22 of a corner or face container an object 15 can be moved from container to container by gravitational force.

Figure 5A:
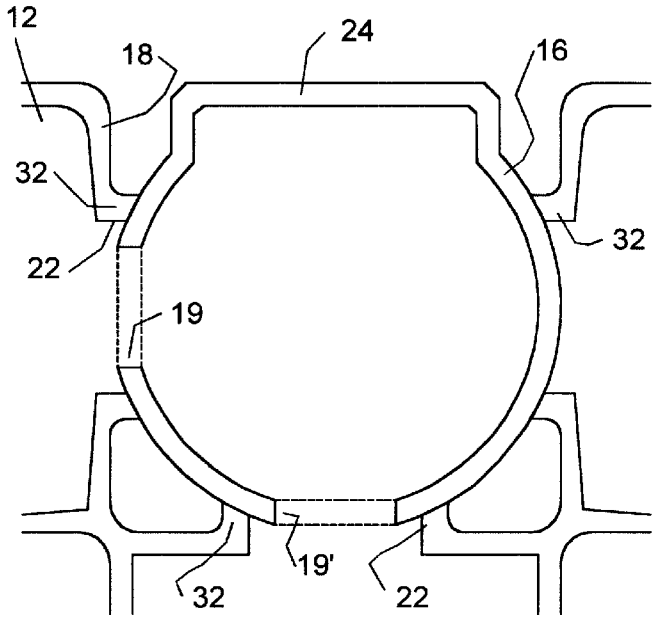
FIG. 5*a* is a partial cross-sectional view of a spherical edge container component situated within the matrix body of the invention.

As shown in FIG. 5*a* apertures 19 and 19' of spherical edge container 16 are of a smaller diameter than aperture 22 of bearing 32. The smaller aperture diameters 19, 19' ensures that the outer surface of spherical edge container 16 is always in contact with bearing(s) 32 thus facilitating the easy manipulation (rotation) of the edge container and alignment of the edge container apertures with the bearing apertures 22.

Figure 5B:
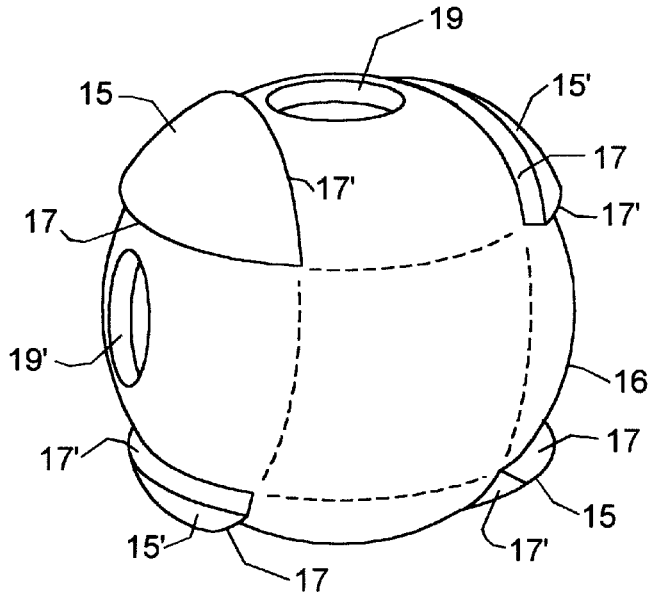
FIG. 5*b* is a perspective view of a spherical edge container embodiment of the invention.
Figure 5C:
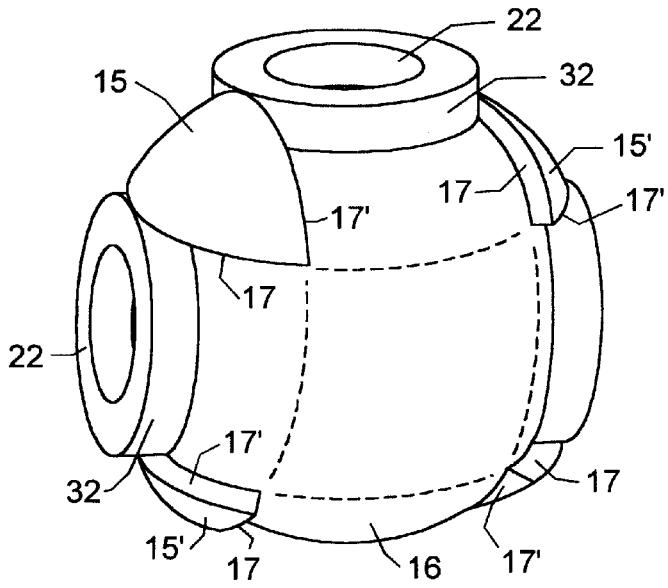
FIG. 5*c* is a perspective view of a spherical edge container embodiment of the invention showing a guide means for rotational and pivotal movement of the container.

Referring to FIGS. 5*b* and 5*c* another aspect of the invention is illustrated. In this embodiment, opposed edge container guide rails 15, 15' protrude outwardly from the outer surface of edge container 16. As shown in FIG. 5*b*, each of guide rails 15, 15' include guide surfaces 17, 17' that are coextensive with the curvature of the outer surface of spherical edge container 16. Guide rail(s) 15, 15' with guide surfaces 17, 17' can be integrally formed with the spherical edge container during the molding process. Guide surfaces 17, 17' of opposed guide rails 15 and 15' are parallel to each other. In other words, guide surface 17' of guide rail 15 is parallel to guide surface 17 of opposed guide rail 15'. As shown in FIG. 5*c*, bearing(s) 32 (edge container recess walls are not shown) is positioned between opposed guide surfaces 17' and 17 of guide rails 15 and 15', respectively. The distance between the opposed guide surfaces is slightly greater than the outer circumferential diameter of bearing 32. By slightly greater is meant that the distance between opposed guide surfaces is sufficient to engage the outer circumferential wall of bearing 32 for a snug fit while permitting the rotational and pivotal movement of the spherical edge container about the bearing. The height of guide surfaces 17 and 17' (the distance that the guide surfaces protrude from the surface of the edge container) should be sufficient to engage the bearing 32 but not greater than the height of the outer circumferential wall of the bearing.

Figure 4D:
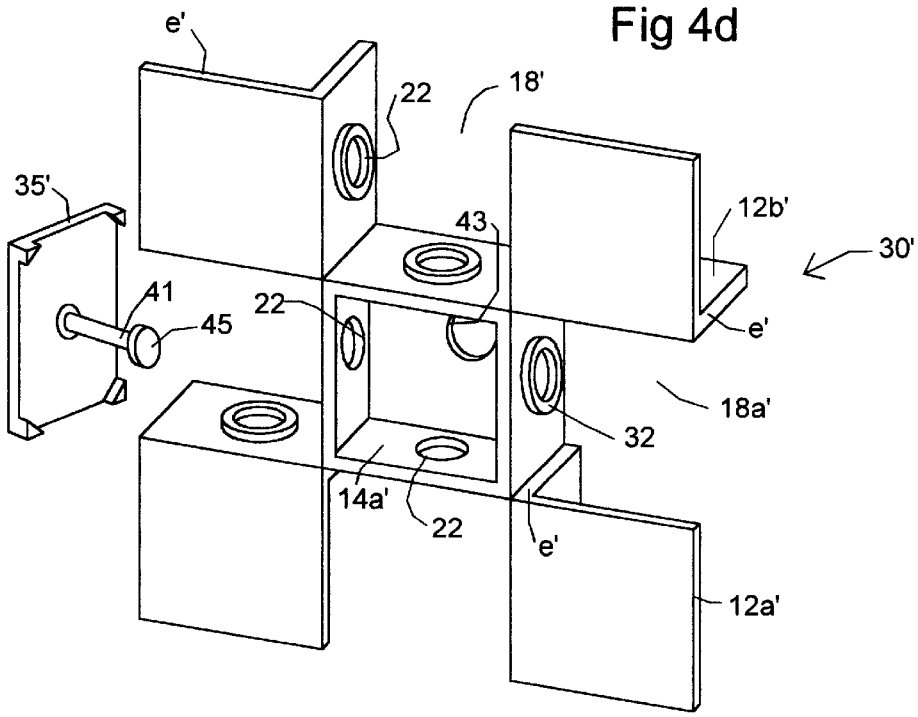
Figure 4E:
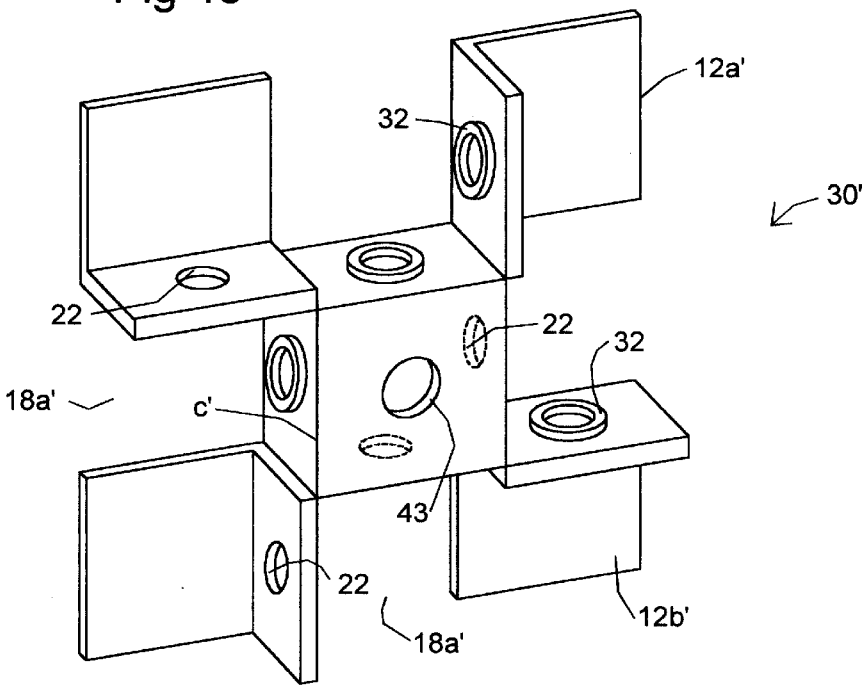
Figure 6:
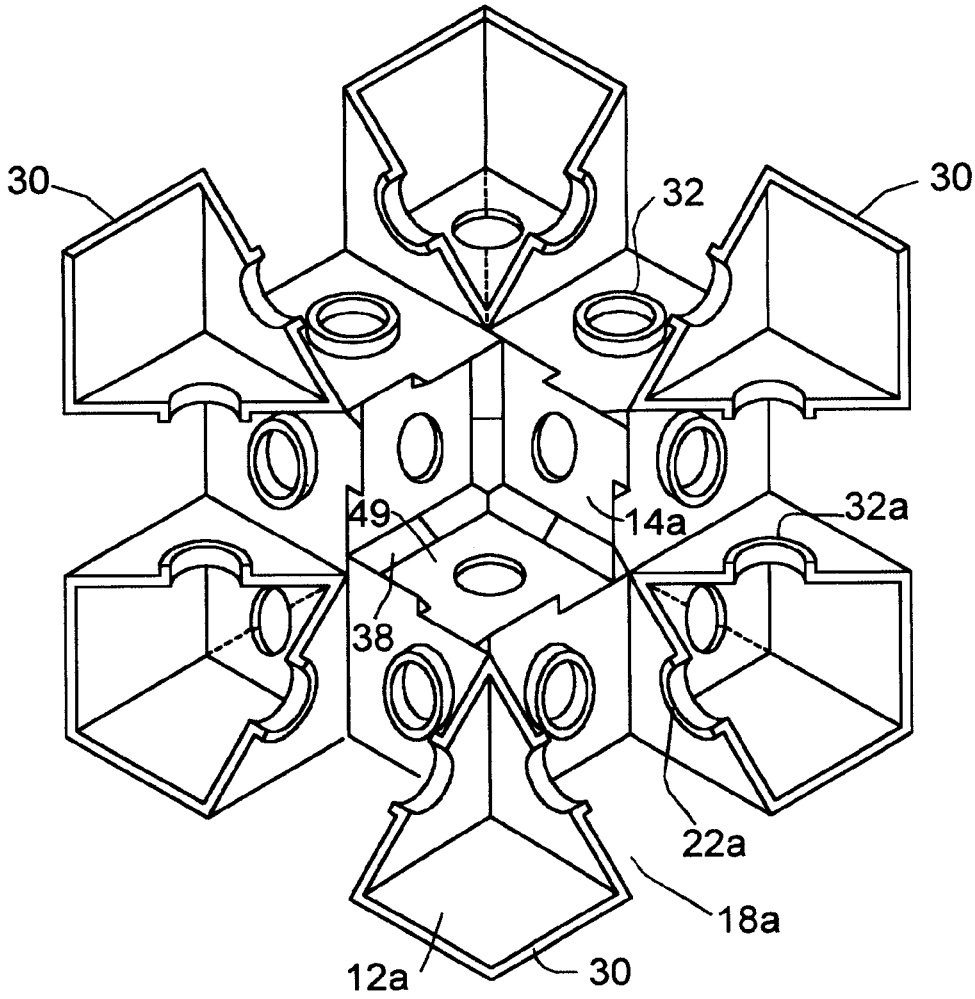
FIG. 6 is a perspective view of a partially assembled matrix body of the invention.

Referring to FIG. 6, the game piece is assembled by aligning each of the six matrix assembly elements 30 into a cube configuration. Each matrix assembly element 30 forms a face of the cube matrix body 20. The edge container spheres 16 are easily inserted between the bearing elements in recess(es) 18 of the assembly because the matrix assembly element is compliant before final fixing. Each matrix assembly element 30 is mated along the alignment tabs 38 located on the rear of face compartment 14*a*. In FIG. 6 a partially assembled matrix body constructed from three matrix assembly elements 30 are mated about alignment tabs 38. When all six matrix assembly elements are mated the spherical containers 16 are placed into recesses 18. The common joints of the matrix assembly elements are then fixed together by adhesive or by welding means. Any adhesive suitable for adhering plastic-plastic interfaces will suffice. When welding is contemplated any suitable welding method for plastics such as ultrasonic welding is contemplated. In another embodiment of the invention, matrix body 20 of the puzzle game is constructed from six identical matrix assembly elements that are assembled to form the matrix body configuration. Referring to FIGS. 4*d* and 4*e* there is shown the front and rear view, respectively, of matrix assembly element 30'. In one aspect of the invention the matrix assembly element can be molded from a plastic resin, such as ABS, that is transparent in the molded or finished state. Each of the six matrix assembly elements 30' includes a box-like face compartment 14*a'* and four partial corner compartments (two each of 12*a'* and 12*b'* are situated on each comer of the face compartment). Alignment tabs (not shown) can be integrally formed on the rear wall edges of box-like face compartment 14*a'* identical to that shown for 14*a* illustrated in FIGS. 4*a* and 4*c*. Similarly, alignment tabs (not shown) can be integrally formed on the vertical and horizontal inside wall edges of partial compartments 12*a'* and 12*b'*. Four partial edge container recess compartments 18*a'* are situated between each of the partial comer compartments 12*a'* and 12*b'*. Each partial edge container recess 18*a'* shares a common wall with box-like face container 14*a'* and with a partial edge container 12*a'* or 12*b'*. Each partial edge container recess element 18*a'* includes two annular apertures 22. One annular aperture is situated in the common wall shared with face container 14*a'* and the other annular aperture is situated in the common wall shared with partial edge container 12*a'* or 12*b'* as illustrated in the figures. Each partial recess element 18*a*' includes two annular bearings 32 which outwardly depend from the circumferential edge of annular aperture 22. The inner diameters of aperture 22 and bearing 32 are of the same dimension. The configuration illustrated in this embodiment is advantageous in that the bearings are integrally fabricated in one piece and do not contain joint or weld lines.

The front face of face compartment 14*a*' can be covered with a center cap as illustrated in FIGS. 3 and 4*a* wherein center cap 35 is mounted on the face of face container 14*a*. Face cap 35 can be adapted for a snap fit engagement (removable engagement) with face container 14*a* or center cap 35 can be permanently adhered or welded onto the face of 14*a*, 14*a'*.

As discussed in the embodiment illustrated in FIG. 6, the game piece is assembled by aligning of six matrix assembly elements 30' along free edges e' of the partial corner compartments 12*a*' and 12*b*' and rear edges c' of face compartment 14*a*'. As illustrated in FIG. 6 a center compartment 49 is formed as the matrix assembly elements are arranged. In the fully assembled state (after the six matrix assembly elements are in place), the center compartment 49 is a totally enclosed cube-like compartment located in the geometric center of the matrix body 20 (shown in FIGS. 2 and 3). The rear walls of face compartments 14*a* or 14*a*' form a face of the cube body of compartment 49. In the embodiment described in FIGS. 4*d* and 4*e*, aperture 43 allows access to the center compartment 49 of the filly assembled matrix body. Compartment 49 can be utilized for the storage of game objects such as marbles, balls, gels, etc. As shown in FIGS. 4*d* and 4*e*, access to center compartment 49 is provided through aperture 43. Aperture 43 must be of sufficient diameter to allow the passage of game objects from compartment 14 (shown in FIGS. 2 and 3) into compartment 49. Access to compartment 49 is blocked when center cap 35' with centrally located peg 41 and closure head 45 is snapped into place over the face of compartment 14*a*'. It should be noted that peg 41 should not obstruct the passage of game objects through compartment 14*a*'. When center cap 35' is snapped into position, closure head 45 obstructs or blocks access in and out of compartment 49. The snap-in center cap with closure head 45 can be utilized in one, several or all of the face containers. Accordingly, aperture 43 need only be present in embodiments where center cap 35' is utilized.

Once the six matrix assembly elements are fixed together, the matrix body becomes rigid so that the edge container spheres can not snap out of position. Spherical containers 16 can be rotated so that holes 19 face the exterior of the matrix to allow objects 15 to be loaded into the game.

By placing movable objects such as marbles in several of the containers of the three dimensional spatial game of the invention, it will be appreciated that by rotating any of the twelve edge containers about their axes and rotating the entire game piece about its axes the marbles can be made to move around the array of containers in virtually a limitless number of permutations.

While an embodiment of the three dimensional spatial game of the invention has been described above, it will be recognized by one of ordinary skill that other embodiments of the game can be constructed with various combinations of fixed and/or movable containers. Three dimensional arrays of containers of different sizes, shapes and number of apertures can be constructed in accordance with the invention. Embodiments can include three dimensional arrays of fixed containers, three dimensional arrays of movable containers and three dimensional arrays including a combination of fixed and movable containers. Stops for blocking the advance of an object into an adjacent container are contemplated within the scope of the present invention.

Figure 7:
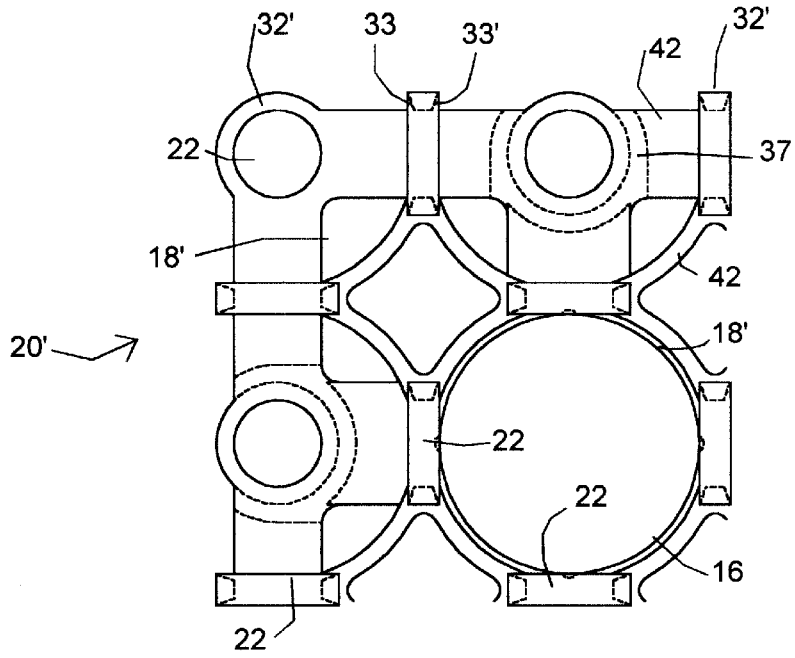
FIGS. 7 and 7*a* are schematic views of an embodiment of the invention utilizing movable container elements.
Figure 7A:
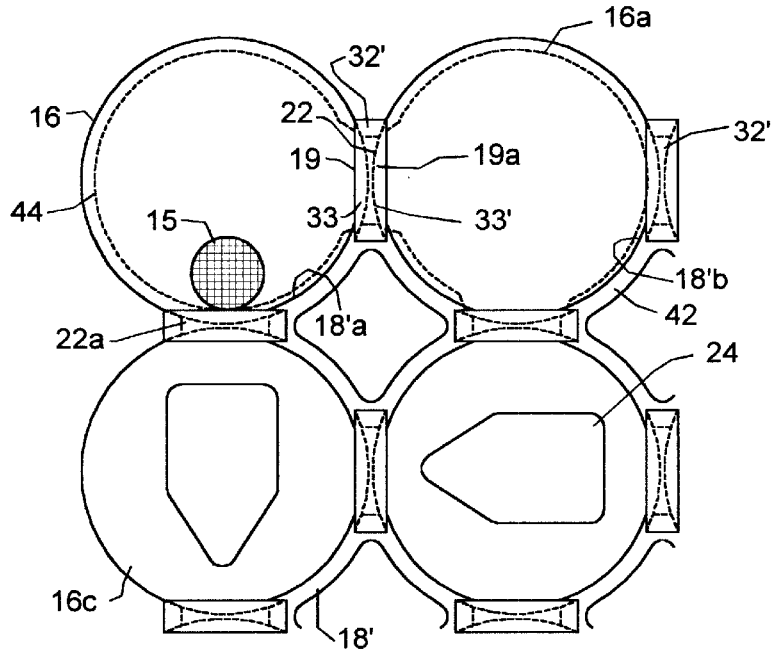

In FIGS. 7 and 7*a* there is illustrated an embodiment of the invention wherein all of the containers in the three dimensional array are movable. In the FIG. 7 there is shown a partial view of matrix body 20' including a support lattice 42 for receiving an array of rotatable sphere-like containers 16 as defined above. The support lattice 42 defines a plurality of adjacent socket-like container recess elements 18' arranged in a three dimensional array. Integral with the support lattice 42 are annular bearings 32'. Bearings 32' are situated between adjacent container recesses 18' and include container contact faces 33 and 33'. Each of container contact faces 33, 33' face toward the interior of adjacent container recess element 18'. Each container recess 18' contains at least three bearing contact faces for receiving and supporting spherical container 16. As set forth in the previous embodiment the container contact faces 33, 33' are beveled to conform to the outer spherical surface of container 16 to facilitate the rotation of the container about its orthogonal axes. Apertures 22 are situated between adjacent container recess elements 18'. The inner circumferential walls of annular bearing elements 32' that are situated between adjacent container recesses are of the same diameter and are contiguous with the circumferential wall of aperture 22.

In FIG. 7*a* apertures 19 and 19*a* of containers 16 and 16*a*, respectively, are shown in alignment with aperture 22 situated between container recesses 18'*a* and 18'*b*. In this situation an open portal is formed allowing object 15 to be transferred into container 16*a* from container 16. Conversely, object 15 is blocked from falling into container 16*c* because the portal through aperture 22*a* is blocked because a container aperture is not aligned therewith.

Figure 8:
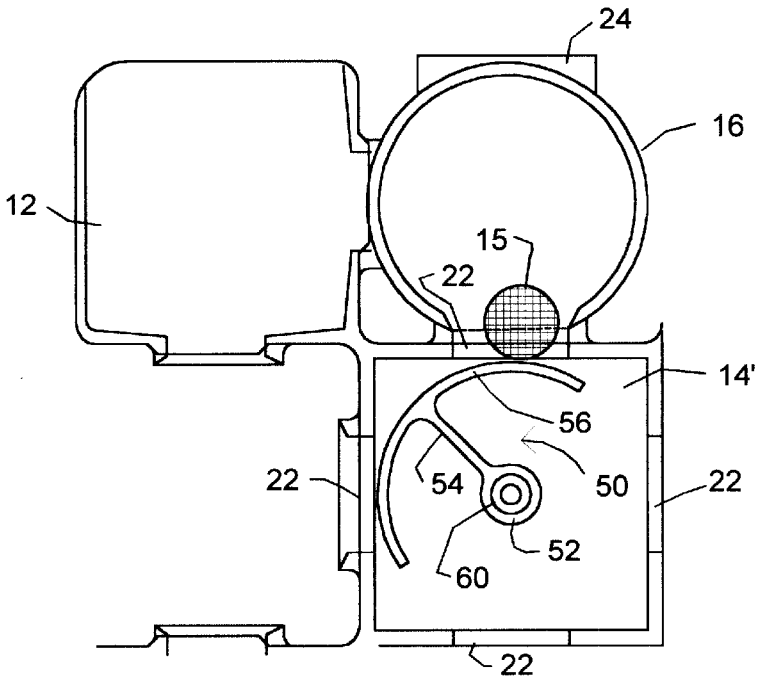
FIGS. 8 and 8*a* are partial sectional views illustrating a blocking mechanism embodiment of the invention.
Figure 8A:
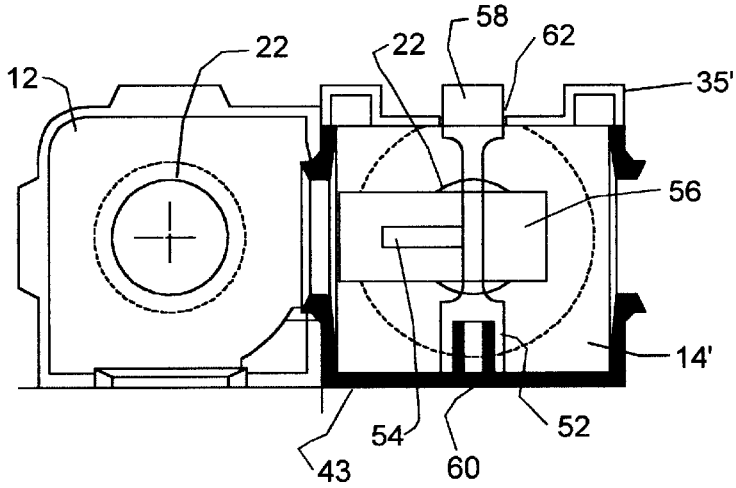

In FIGS. 8 and 8*a* means for blocking or controlling the movement of an object 15 into or out of a fixed container is illustrated. In FIG. 8 there is shown a partial view of puzzle game 10 as previously described. In this embodiment face container 14' (center cap not shown) includes a blocker arm 50 pivotably mounted therein. The blocker arm includes a curved blocker element 56 that is attached to a bearing sleeve 52 by a connecting arm 54. Bearing sleeve 52 is pivotably mounted to an axle 60. As shown in FIG. 8*a* axle 60 depends perpendicularly from a rear wall 43 of the face container. The axle 60 is situated at the geometric center of rear wall 43. The front face of container 14' is covered by center cap 35'. Blocker arm 50 includes a handle 58 which extends from bearing sleeve 52 through aperture 62 of center cap 35'. Blocker element 56 is of a curvilinear configuration and can be sized to block one, two or three apertures 22. The blocker 50 can be rotated by a player to block the advance of an object 15 through any of apertures 22 into or out of a fixed container 12, 14 of the invention.

What is claimed is:

1. A puzzle game assembly comprising an array of adjacent containers each having at least one aperture through the surface thereof, an object located within at least one of said containers capable of being transferred between said adjacent containers, and means for selectively permitting or preventing the transfer of said object between said adjacent containers, wherein a portion of said adjacent containers are cube-like in configuration and a portion of said adjacent containers are spherical in configuration.

2. The puzzle game set forth in claim 1 wherein said spherical containers are situated among and contiguous with at least two cube-like containers within said array.

3. The puzzle game set forth in claim 2 wherein said cube-like containers are fixed in position within said array.

4. The puzzle game set forth in claim 3 wherein said spherical containers are rotatable.

5. The puzzle game set forth in claim 4 wherein each of said spherical containers are rotatable about its orthogonal (x, y and z) axes.

6. The puzzle game set forth in claim 5 wherein said spherical container is capable of being rotated 360° about its x and z axis.

7. The puzzle game set forth in claim 5 wherein said spherical container pivots about 90° around its y axis.

8. The puzzle game set forth in claim 4 wherein an aperture in said cube-like containers is adjacent to and contiguous with the surface of said spherical container.

9. The puzzle game set forth in claim 8 wherein said spherical container is rotatable to a position wherein an aperture in said spherical container is aligned with said aperture(s) in said cube-like containers forming a portal from one container to the other.

10. The puzzle game set forth in claim 9 wherein said spherical container is rotatable to a position wherein an aperture in said cube-like containers is blocked by the surface of said spherical container.

11. The puzzle game set forth in claim 9 wherein said aperture(s) in said cube-like containers that is adjacent to and contiguous with the surface of said spherical container is annular and includes a annular bearing that has an inner circumferential wall that is coextensive with the annular periphery of said aperture, said annular bearing being contiguous to and in contact with the surface of said spherical container.

12. The puzzle game set forth in claim 11 wherein said spherical container(s) is situated among and contiguous with four cube-like containers within said array.

13. The puzzle game set forth in claim 12 wherein said spherical container is mounted between at least two of said annular bearings.

14. The puzzle game set forth in claim 13 wherein said spherical container is positioned between four annular bearing elements each of said bearing elements being situated on a separate cube-like container.

15. A puzzle game comprising an array of 26 containers arranged within a cube-like matrix assembly wherein each face of said cube-like assembly includes a 3 by 3 array of adjacent containers, said cube-like assembly including 8 fixed corner containers situated at each comer of said cube-like assembly, 6 fixed face containers each situated at the center of the 3 by 3 container array on each face of said cube-like assembly, and 12 rotatable edge containers situated between said comer containers, each of said 26 containers having at least one aperture through the surface thereof, an object located within at least one of said containers capable of being transferred between adjacent containers.

16. The puzzle game set forth in claim 15 wherein said comer containers and said face containers are cube-like in configuration.

17. The puzzle game set forth in claim 16 further comprising a cube-like container situated in the geometric center of said three dimensional array that is adjacent to and contiguous with each of said face containers.

18. The puzzle game set forth in claim 15 wherein said matrix assembly is formed from 6 identical elements.

19. The puzzle game set forth in claim 15 wherein each of said edge containers are rotatable about its orthogonal (x, y and z) axes.

20. The puzzle game set forth in claim 19 wherein said edge container is capable of being rotated 360° about its x and z axis.

21. The puzzle game set forth in claim 20 wherein said edge container pivots about 90° around its y axis.

22. The puzzle game set forth in claim 15 wherein an aperture in said cube-like container(s) is adjacent to and contiguous with the surface of said edge container.

23. The puzzle game set forth in claim 15 wherein said edge container is rotatable to a position wherein an aperture in said edge container is aligned with said aperture(s) in said cube-like containers forming a portal from one container to the other.

24. The puzzle game set forth in claim 23 wherein said edge container is rotatable to a position wherein an aperture in said cube-like containers is blocked by the surface of said edge container.

25. The puzzle game set forth in claim 23 wherein said aperture(s) in said cube-like container(s) that is adjacent to and contiguous with the surface of said edge container is annular and includes an annular bearing having an inner circumferential wall that is coextensive with the annular periphery of said aperture, said annular bearing being contiguous to and in contact with the outer surface of said edge container.

26. The puzzle game set forth in claim 11 wherein said edge container(s) is situated among and contiguous with four cube-like containers within said array.

27. The puzzle game set forth in claim 26 wherein said edge container is situated between at least two of said annular bearings.

28. The puzzle game set forth in claim 27 wherein said edge container is positioned between four annular bearing elements each of said bearing elements being situated on a separate cube-like container.

* * * * *